US006814461B2

(12) United States Patent
Minalga

(10) Patent No.: US 6,814,461 B2
(45) Date of Patent: Nov. 9, 2004

(54) BATTERY-OPERATED POWER TOOL WITH LIGHT SOURCE

(75) Inventor: Philip F. Minalga, Pendleton, SC (US)

(73) Assignee: One World Technologies Limited, Hamilton (BM)

( * ) Notice: Subject to any disclaimer, the term of this patent is extended or adjusted under 35 U.S.C. 154(b) by 54 days.

(21) Appl. No.: 10/378,117

(22) Filed: Mar. 3, 2003

(65) Prior Publication Data

US 2004/0174699 A1 Sep. 9, 2004

(51) Int. Cl.[7] ..... B25B 23/18
(52) U.S. Cl. ..... 362/119; 362/205; 315/86
(58) Field of Search ..... 315/209 CD, 360, 315/291, 86; 362/118, 119, 120, 190, 191, 205

(56) References Cited

U.S. PATENT DOCUMENTS 5,169,225 A 12/1992 Palm
5,179,325 A 1/1993 Aragon, Jr.
5,473,519 A 12/1995 McCallops et al.
6,318,874 B1 * 11/2001 Matsunaga ..... 362/119
6,612,713 B1 * 9/2003 Kuelbs ..... 362/102
6,729,743 B2 * 5/2004 Gillette ..... 362/119

* cited by examiner

*Primary Examiner*—Wilson Lee
(74) *Attorney, Agent, or Firm*—Brooks Kushman P.C.

(57) ABSTRACT

A battery-operated power tool includes housing, a motor disposed in the housing, a battery, a light source, a driver circuit, and first and second physical switches. The driver circuit includes a transistor configured as a switch connecting the battery to the light source. The driver circuit further includes a capacitor arranged to form a timer. The first physical switch is arranged such that its assertion connects the battery to the light source for a predetermined period of time. The second physical switch is separate from the first physical switch and is arranged such that its assertion connects the battery to the motor.

7 Claims, 1 Drawing Sheet

BATTERY-OPERATED POWER TOOL WITH LIGHT SOURCE

BACKGROUND OF THE INVENTION

1. Field of the Invention

The present invention relates to battery-operated power tools having light sources for illuminating the work area.

2. Background Art

The use of battery-operated power tools has become widespread. Some of these tools are provided with a light source for illuminating the work area. One approach for providing the light source is to provide a simple switch for turning the light source on and off. Another approach is to provide a momentary contact switch in conjunction with a timer circuit so that the momentary assertion of the switch causes the light to turn on and remain on until the expiration of a predetermined time delay. Most timer circuits that use a time delay device such as a 555 integrated circuit timer require the battery voltage to be powering the device before and after the desired time delay has been activated. The power on the timer will constantly drain the battery whether the time delay circuit has been activated or not. After sufficient time, the battery will become totally discharged resulting in total battery failure.

Some background information may be found in U.S. Pat. Nos. 6,318,874, 5,473,519, 5,179,325, and 5,169,225. U.S. Pat. No. 6,318,874 describes a power tool having a lighting device. In that patent, a single switch causes the motor and the light to operate at substantially the same time and there is no way to turn on the light without actuating the motor.

For the foregoing reasons, there is a need for a battery-operated power tool with a light source that avoids the problem of constant drain on the battery, and avoids limitations associated with other existing designs.

SUMMARY OF THE INVENTION

It is, therefore, an object of the present invention to provide an improved battery-operated power tool utilizing a driver circuit for implementing time delay turn off of a light source.

In carrying out the above object, a battery-operated power tool is provided. The power tool comprises a housing, a motor disposed in the housing, a battery, a light source, a driver circuit, and first and second physical switches. The driver circuit includes a transistor configured as a switch connecting the battery to the light source. The driver circuit further includes a capacitor arranged to form a timer. The momentary charging of the capacitor causes the transistor switch to close and to remain closed for a predetermined period of time while the capacitor at least partially discharges. The first physical switch is arranged such that assertion of the first physical switch charges the capacitor. The second physical switch is separate from the first physical switch. The second physical switch is arranged such that assertion of the second physical switch connects the battery to the motor.

It is appreciated that the light source may be a light emitting diode (LED) or other suitable light source. It is appreciated that the driver circuit transistor may be a bipolar junction transistor (BJT), a field effect transistor (FET) or any other suitable transistor. It is appreciated that the capacitor may be arranged to form the timer in a variety of ways, for example, having the capacitor discharge through the transistor, through a resistor, or through both the transistor and a resistor. It is appreciated that the momentary charging and subsequent discharging of the capacitor may take place in a variety of ways depending on the transistor configuration (for example, npn BJT, pnp BJT, n-channel FET, or p-channel FET).

At a more detailed level, the invention comprehends a zener diode arranged such that the zener diode voltage drives the light source. This provides a constant drive on the light source and near constant light intensity level. In the preferred embodiment, the transistor is a bipolar junction transistor (BJT). More preferably, the light source is connected at the emitter of the bipolar junction transistor (BJT) as opposed to other possible connections such as at the collector.

The above object and other objects, features, and advantages of the present invention are readily apparent from the following detailed description of the preferred embodiment when taken in connection with the accompanying drawings.

DETAILED DESCRIPTION OF THE PREFERRED EMBODIMENT

Figure 1:
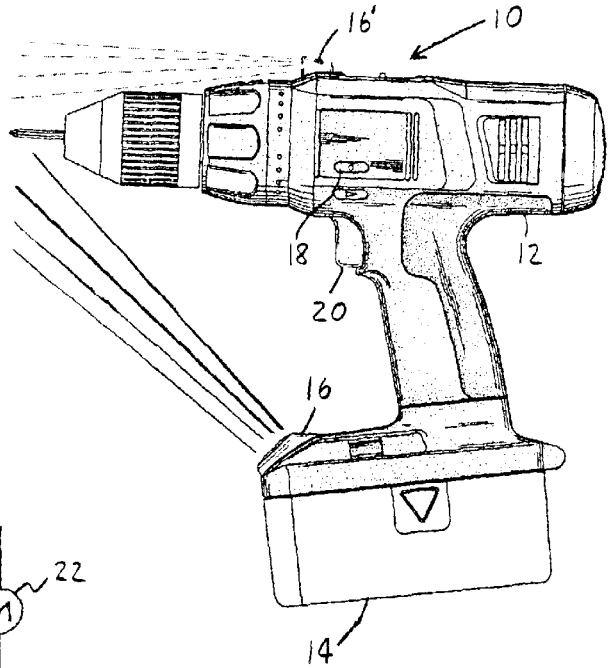
FIG. 1 illustrates a battery-operated power tool made in accordance with the present invention.

A battery-operated power tool is generally indicated at 10. Power tool 10 includes a housing 12 and battery 14. Power tool 10 further includes light source 16, first switch 18 for activating light source 16, and second switch 20 for activating the motor 22.

Figure 3:
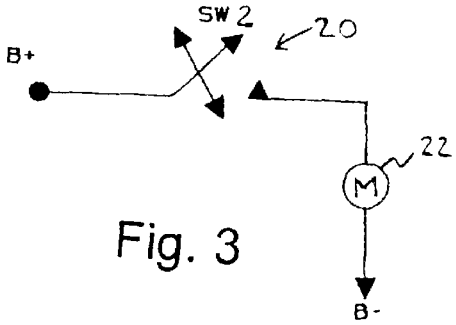
FIG. 3 illustrates a simple circuit for connecting the battery to the motor.
Figure 2:
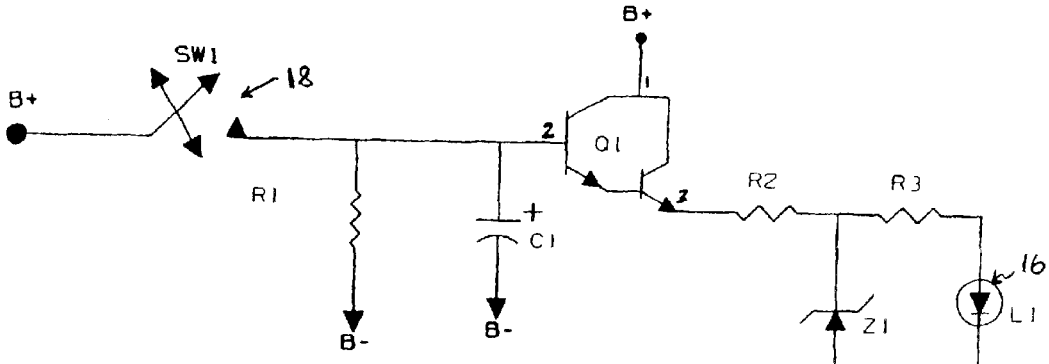
FIG. 2 illustrates a preferred implementation of the driver circuit for connecting the battery to the light source.

The driver circuit for connecting battery 14 to light source 16 is shown at a detailed level in FIG. 2, while the motor drive circuit for connecting battery 14 to motor 22 is shown in FIG. 3. First switch 18 includes circuit level switch element SW1. Light source 16 includes white light emitting diode (LED) L1. Second switch 20 includes circuit level switch element SW2. Light source 16 is located adjacent to battery 14 in FIG. 1 to direct light toward the working region of the tool. Alternatively, light source 16' may be provided on another region of housing 12 of power tool 10 or multiple lights may be used to reduce shadows.

With continuing reference to FIG. 2, switch SW1 is a single pole, single throw, and momentary type switch. Switch SW1 is biased to the unasserted condition and the momentary assertion of switch SW1 momentarily closes/activates the switch to charge capacitor C1 to the battery voltage B+(for example, 14.4 volts dc). This voltage will drive transistor Q1 on. The illustrated Darlington configuration is preferred but not required. The emitter voltage of transistor Q1 will drive the zener Z1 biased by resistor R2. The zener voltage (for example, 5.1 volts de) will drive the LED L1 through resistor R3. The zener Z1 will maintain a constant drive on LED L1 keeping the light intensity at a near constant level.

When switch SW1 is released, the capacitor C1 will immediately begin to discharge through resistor R1 and the base of transistor Q1. Even though the switch SW1 has been released, the LED will remain at a constant illumination for a period of time until the zener voltage begins to fall below its zener level.

When the capacitor C1 voltage has been discharged sufficiently, transistor Q1 will no longer drive the zener Z1 and the LED will extinguish entirely. When the LED has been extinguished, the time delay circuit does not require or draw power from the battery, thereby preventing battery discharge and battery failure.

In operation, a user momentarily asserts switch 18 (FIG. 1) causing switch element SW1 to momentarily close resulting in LED L1 being driven for a period of time to direct light toward the working region of the tool with light 16 and alternatively with light 16'. Trigger switch 20 is then asserted to power the tool.

Embodiments of the present invention have several advantages. First, the time delay circuit avoids the problem of constant drain on the battery. Further, first and second separate physical switches are used for the light source and the motor. In this way, the light source can be operated independently of the motor, and can be turned on without activating the motor at tie same time.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A battery-operated power tool comprising:

a housing;

a motor disposed in the housing;

a battery;

a light source;

a driver circuit including a transistor configured as a switch connecting the battery to the light source, the driver circuit further including a capacitor arranged to form a timer such that the momentary charging of the capacitor causes the transistor switch to close and to remain closed for a predetermined period of time while the capacitor at least partially discharges;

a first physical switch arranged such that assertion of the first physical switch charges the capacitor; and a second physical switch that is separate from the first physical switch, the second physical switch being arranged such that assertion of the second physical switch connects the battery to the motor.

2. The power tool of claim 1 further comprising:

a zener diode arranged such that the zener diode voltage drives the light source.

3. The power tool of claim 1 wherein the transistor is a bipolar junction transistor.

4. The power tool of claim 3 wherein the light source is connected at the emitter of the bipolar junction transistor.

5. A battery-operated power tool comprising:

a housing;

a motor disposed in the housing;

a battery;

a light source;

a driver circuit including a npn bipolar junction transistor configured as a switch connecting the battery to the light source, the driver circuit further including a capacitor connected to the transistor base such that the momentary charging of the capacitor causes the transistor switch to close and to remain closed for a predetermined period of time while the capacitor at least partially discharges;

a first physical switch arranged such that assertion of the first physical switch charges the capacitor; and a second physical switch that is separate from the first physical switch, the second physical switch being arranged such that assertion of the second physical switch connects the battery to the motor.

6. The power tool of claim 5 further comprising:

a zener diode arranged such that the zener diode voltage drives the light source.

7. The power tool of claim 5 wherein the light source is connected at the emitter of the bipolar junction transistor.

* * * * *